United States Patent [19]

Godbold et al.

[11] Patent Number: 4,681,598

[45] Date of Patent: Jul. 21, 1987

[54] METHOD OF REMOVING PYRITIC SULFUR FROM COAL

[75] Inventors: Thomas M. Godbold; William R. Baker, both of Nashville, Tenn.

[73] Assignee: Vanderbilt University, Nashville, Tenn.

[21] Appl. No.: 809,922

[22] Filed: Dec. 16, 1985

[51] Int. Cl.[4] ..... C10L 9/08

[52] U.S. Cl. ..... 44/1 SR; 48/210; 201/17; 208/400

[58] Field of Search ..... 44/1 SR; 201/17; 48/210; 208/400

[56] References Cited

U.S. PATENT DOCUMENTS 3,272,721 9/1966 Loevenstein ..... 201/17 X

OTHER PUBLICATIONS

Attar, Fuel, 57:201–212 (1978).
Mazumdar et al., Fuel, 41:212 (1962).
Huang et al., pp. 290–304, in "Coal Desulfurization: Chemical and Physical Methods," Wheelock, editor, American Chemical Society, Washington, D.C. (1977).
Haldipur et al., pp. 305–320 in "Coal Desulfurization: Chemical and Physical Methods", Wheelock, editor, American Chemical Society, Washington, D.C. (1977).
Fleming et al, pp. 267–279, "Coal Desulfurization: Chemical and Physical Methods," Wheelock, editor, American Chemical Society, Washington, D.C. (1977).
Speight, "The Chemistry and Technology of Coal", Marcel Dekker, Inc., New York (1983).
Powell, J. Ind. Engr. Chem., 12:1069–1977 (1920).

*Primary Examiner*—Carl F. Dees
*Attorney, Agent, or Firm*—Tilon, Fallon, Lungmus & Chestnut

[57] ABSTRACT

Pyritic sulfur is removed from coal to concentrate gas fraction collecting a gas fraction at decomposition temperatures within the range from 375° to 550° C. The collected fraction contains at least 60% of the total composable sulfur and not over 40% of the evolvable gas.

9 Claims, 1 Drawing Figure

METHOD OF REMOVING PYRITIC SULFUR FROM COAL

FIELD OF INVENTION, BACKGROUND, AND PRIOR ART

The field of the invention is the removal of sulfur from coal. In particular, the method is concerned with coal decomposition during which gaseous products of pyritic sulfur are evolved.

Iron disulfide ($FeS_2$) is one of the major sulfur compounds found in coal. It can appear in two crystalline forms, the pyrite (cubic) and the marcasite (rhombic). Since most of the iron disulfide is usually in the pyrite form, the names "pyrites" and "pyritic sulfur" are often used to designate all of the $FeS_2$, and are so used in this application.

The chemical reactivity of the two forms of pyrites is similar. Thermal decomposition of pyritic sulfur converts the iron disulfide to iron sulfide and free sulfur. The resulting nascent sulfur then reacts with other products. See, Attar, Fuel, 57:201–212 (1978). The sulfur is evolved as hydrogen sulfide ($H_2S$) and not as elemental sulfur.

In the pyrolysis of coal a mixture of volatile products is produced. Hydrogen is the principal reactant with the sulfur formed by the decomposition of the pyrites, resulting in the hydrogen sulfide ($H_2S$) decomposition product. See, Mazumdar et al., *Fuel,* 41:121 (1962). Mazumdar found that the reaction of sulfur with hydrogen has an appreciable rate even at temperatures as low as 170° C. Hydrogen also reacts directly with pyrites to form ferrous sulfate and hydrogen sulfide. Huang et al., pages 290–304, in "Coal Desulfurization: Chemical and Physical Methods," Wheelock, editor, American Chemical Society, Washington, D.C. (1977). In the same publication, see also Haldipur et al., pages 305–320.

The reaction of hydrogen with pyrites begins around 300° C. (Fleming et al., pages 267–279, in "Coal Desulfurization: Chemical and Physical Methods," cited above.) In the thermal decomposition of coal, hydrogen begins to be evolved at temperatures in the range of 300°–400° C. Therefore, the reactions forming hydrogen sulfide from pyrites are dependent on pyrolysis temperatures. Other reactions of iron sulfide require temperatures in excess of 800° C. (See Attar, 1978, cited above.)

In addition to Huang et al. and Haldipur, et al., cited above, literature references relating to the removal of pyritic sulfur from coal include: Speight, "The Chemistry and Technology of Coal," Marcel Dekker, Inc., New York (1983); and Powell, *J. Ind. Engr. Chem.,* 12:1069–1977 (1920).

Huang et al. studied Iowa coal containing pyrites. The amount of sulfur volatilized in heating the coal from 250° C. to 700° C. in an atmosphere of nitrogen was determined. Reported data indicates a steady increase in sulfur evolution between 300 and 500° C. with some decrease in the rate of 500° C. Speight generalized that hydrogen sulfide is released between 250 and 500° C. Haldipur found that nearly 30% of the total sulfur was released in heating coal from 320° C. to 400° C. Powell studied several reactions involving sulfur and coal. He concluded that the decomposition of pyrite begins at 300° C. and is complete at 600° C., the maximum being between 400 and 500° C. Powell also found that one-fourth to one-third of the organic sulfur is decomposed to $H_2S$ below 500° C.

As far as is known, the cited studies have not resulted in any commercial application for the desulfurization of coal. Pyrolytic decomposition of coal to produce a product gas has been conventionally carried out for many years, but such pyrolytic decomposition has been employed primarily with low sulfur coals.

THE DRAWING

FIG. 1 in the accompanying drawing is a plot of data illustrating the scientific basis for the present invention. This diagram shows that the evolution of sulfur as a gaseous product proceeds at a faster rate than the evolution of other gaseous products.

SUMMARY OF INVENTION

This invention is based on the discovery that pyritic sulfur products formed during pyrolysis of coal can be concentrated into a small volume of the evolved gas. It was not previously recognized that the rate of sulfur evolution during pyrolysis is much greater in certain temperature ranges than the overall rate of gas evolution. This discovery makes it possible to subject high sulfur coal to thermal decomposition while obtaining a substantial fraction of the gaseous product with a sulfur concentration low enough to permit utilization of the gas without clean up. The smaller fraction of gas containing the high sulfur concentration can be more economically processed for removal of the sulfur. The procedure can be applied to operations in which coal gas is being produced as the gaseous product and coke as the solid product. It can also be applied as a preparatory step for the combustion of coal, the coal being first subjected to decomposition conditions for the purpose of removing most of the pyritic sulfur in a concentrated gas fraction.

DETAILED DESCRIPTION

Figure 1:
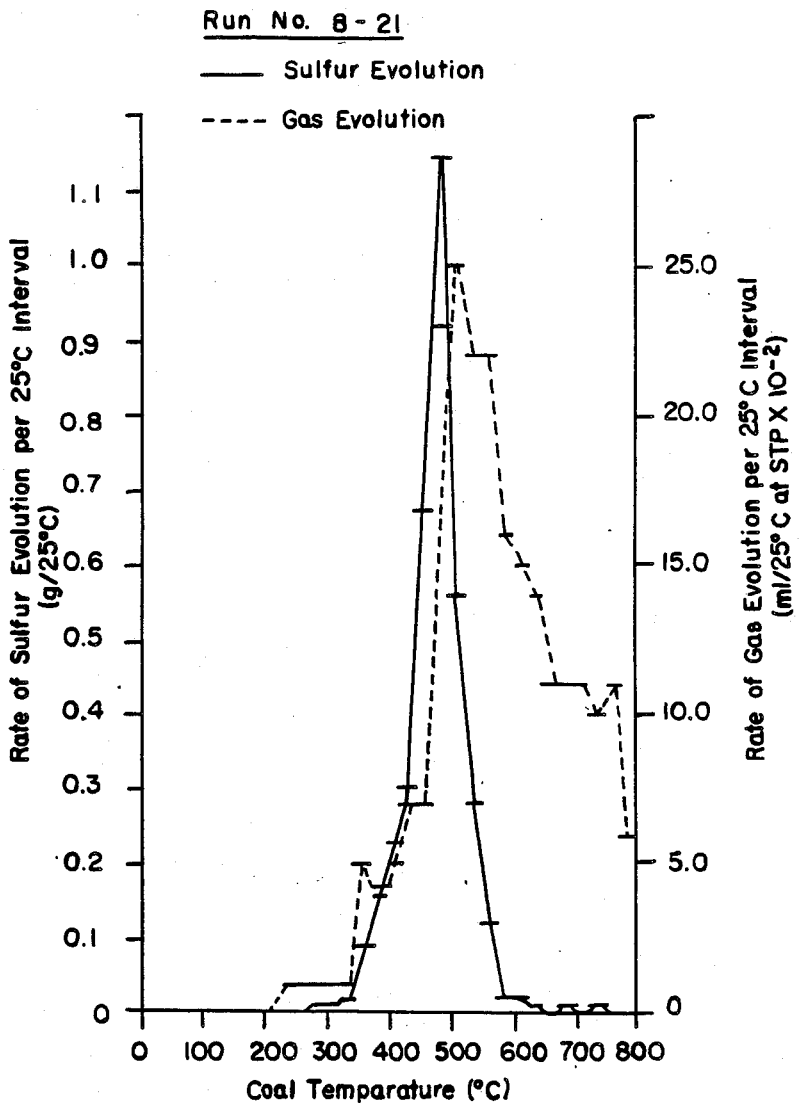

The method of this invention is applicable to any coal containing sulfur in excess of the compliance requirements. More specifically, the method is particularly applicable to coal containing in excess of 1% pyritic sulfur based on the dry weight of the coal. The coals may contains other sulfur compounds removable by the methods of this invention. Some coals contain up to as much as 6% pyritic sulfur. A preferred use of the method is therefore with coals containing in excess of 2% such as up to 6% or higher pyritic sulfur.

The coal can be prepared in a similar manner for coking or combustion uses. It is pulverized and ground to a finely-divided condition. The particle size is not critical and may vary over a considerable range. As an illustrative example, the particles of coal may have an average diameter of around $\frac{1}{8}$ to $\frac{1}{4}$ inches.

The ground coal containing the pyritic sulfur is subjected to thermal decomposition with evolution of gas containing sulfur compounds formed from the pyritic sulfur and evolved during heating. During the pyrolysis, the temperature of the coal is progressively increased as the coal volatiles are converted into gas. In addition to the sulfur products ($H_2S$, etc.) these volatiles will contain methane, hydrocarbons, and hydrogen. The evolved gases are potentially usable as a fuel gas, viz., coal gas. The temperature range for producing coal gas with coke as a by-product can include heating up to 1000° C. However, most of the gaseous products are evolved over the temperature range from 200° to 800° C.

Heretofore it has been the practice to collect the gaseous products as a single fraction. The gas is usually treated to prepare the coal gas for fuel use. Such treatment includes cooling to remove condensables, viz. coal tar, light oils, etc. The gas is also usually treated to remove ammonia. It has not been conventional, however, to treat the gas to remove hydrogen sulfide. The practice has been to employ a coal containing relatively low amounts of pyritic sulfur. Such low sulfur coals typically contain less than 2% total sulfur, and less than 1% pyritic sulfur.

In the method of this invention, progressive heating of the coal being pyrolized is especially important in the range from 375° to 550° C. In the temperature range from 200° to 375° C., the off-gas will contain very little sulfur product. The rate of conversion of the pyritic sulfur to hydrogen sulfide increases rapidly at a temperature range from 375° to 550° C. In accordance with the present invention, a separate gas fraction is collected within the temperature range of 375° to 550° C. (or portion thereof) in which the pyritic sulfur is more rapidly evolved. One preferred temperature range for collecting this separate gas fraction is from 400° to 525° C. Under those conditions, a first low sulfur gas fraction can be collected at a temperature range from 200° to 400° C., a separate high sulfur gas fraction collected in the range from 400° to 525° C., and a third low sulfur gas fraction collected in the range from 525° to 800° C. The first and third fractions can be combined to produce a product gas which does not require treatment to remove the $H_2S$ even though made from a high sulfur coal.

A separate gas fraction collected in the temperature range from 375° to 550° C. preferably contains at least 60% by weight of the total decomposable pyritic sulfur and not over 40% by volume of the total evolvable gas. Correspondingly, the first and third gas fractions referred to above together preferably contain at least 60% of the gaseous product with less than 40% of the hydrogen sulfide produced from the pyritic sulfur. In other preferred embodiments, the combined first and third fractions will contain at least 65% of the evolved gas and less than 30% of the decomposed pyritic sulfur. Correspondingly, the second fraction containing the higher sulfur concentration comprises less than 35% of the evolable gas and over 70% of the pyritic sulfur. Typically, the high sulfur fraction may comprise 25 to 35% of the evolved gas and contain from 70 to 95% of the pyritic sulfur.

The heating of the coal may be carried out by conventional procedures. For example, the coal may be heated in coke ovens designed for producing by-product gas. Indirect heating may be used with flues extending through the bed of coal. In other embodiments, the coal may be heated by pressing a hot gas directly through the bed of the coal. A low grade fuel gas can be used for this purpose and recirculated to conserve heat. Alternatively, the heating gas can comprise an inert gas, such as nitrogen or carbon dioxide. By passing a gas through the coal, it acts as a carrier, promoting volatilization of the gaseous components.

In still another embodiment, coal may be treated on a traveling grate, such as employed as a stokes for feeding a coal-fired furnace. The grate may be designed so that hot gases can be passed upwardly through the moving coal bed. The gases may be controlled so as to progressively heat the coal as it moves along the traveling grate. Above the grate there could be provided a series of chambers for separate collection of gaseous fractions. As an illustrative example, the chamber comprising zone 1 can collect gases evolved at temperatures up to 400° C., a second chamber can collect gases evolved at temperatures from 400° to 525° C., and a third chamber can collect gases from 525° C. up to 800° C. For more precise fractionation more chambers can be used.

In the illustration given, the gas fraction collected in the second chamber will comprise the high sulfur-low volume gas, requiring treatment to remove the sulfur. The fractions collected in chambers 1 and 3 can be combined to form a larger volume gaseous product ready for direct utilization without desulfurization. The coke product can be fed to a furnace or can be recovered for later use as a fuel. The combined gases from chambers 1 and 3 can be burned as a fuel without further treatment or subjected to chemical processing operations. The benzene oils and tars can be recovered, and the residual gas used as a fuel. The gas from the second chamber can be passed to a desulfurization unit in which condensable hydrocarbons are recovered (e.g., benzene, oils and tars). After removal of the sulfur, the noncondensables can comprise a combustible gas product.

EXPERIMENTAL EXAMPLE

General Method

The method employed involved heating a weighed sample of coal in a step-wise fashion and determining the volume and sulfur (i.e., sulfur compounds) content of the off-gas evolved during each step. From these two pieces of information the concentration of sulfur in the off-gas can be calculated as a function of coal temperature.

The coal is heated from 100° C. to 800° C. in temperature increments of approximately 40° C. Nitrogen flowing at a constant rate of approximately 40 ml/min (STP) is used as a carrier gas to aid in the removal of the gaseous products. Sulfur content is determined by absorbing the sulfur containing compounds and then analyzing the absorbing solutions. The total gas volume is measured by a wet-test meter. Finally, the off-gas (gas produced by coal) volume is determined from the total gas volume by subtracting the carrier gas volume and adding the volume of the sulfur compounds.

Coal Sample

The coal used was a high sulfur coal. An analysis of Coal Sample 8-21 is shown below.

| | Sample No. 8-21 | |
|---|---|---|
| Components | Coal | Char |
| Ash | | 30.65 |
| Volatiles | 32.22 | 5.51 |
| Fixed Carbon | 44.0 | 63.84 |
| Pyritic Sulfur | 3.49 | |
| Total Sulfur | 9.01 | 6.23 |

Apparatus

The equipment consisted of an oven, a coal bomb, a recorder, two condensers, four absorbers, and a wet test meter. The oven was electrically heated through four heating elements. Two of the elements are located on the sides of the oven and are powered by an adjustable reostat. The other two elements are located on the top and bottom of the oven. These two elements are connected to a temperature controller. The top and bottom heating elements are only used to heat the oven during a new temperature step. After the new temperature is obtained, a thermocouple signals the controller to turn off these two elements. The new temperature is maintained by the two side heating elements and generally varies less than 10° C. from the set point.

The recorder was a Honeywell strip chart recorder and was used to record both the oven and coal temperatures. The temperatures are measured by chromel-alumel (K-Type) thermocouples, the thermocouple measuring the coal temperature being located inside the bomb near the center of the coal sample, and the oven-temperature thermocouple being located outside the bomb near its surface.

Two condensers were used to cool the off-gas before it reached the absorbers. Sulfur compounds were stripped from the gas in the absorbers. A wet test meter was located after the last absorber to measure the remainder of the evolved gas.

Nitrogen was used to sweep the coal in the oven and carry the off-gas through the system. Nitrogen at approximately 40 ml/min (STP) entered the bomb through a ¼ inch 316 stainless steel tube. The tube is coiled inside the oven so that the nitrogen has the opportunity to reach oven temperature before entering the bomb. The nitrogen carries the off-gas out of the bomb, through both condensers, in and out of each absorber, and then into the wet test meter.

Sulfur Analysis

The amount of sulfur in the off-gas was determined by bubbling all of the nitrogen carried off-gas through a series of solutions that absorb the sulfur containing compounds. The absorbing solutions were then titrated to quantitatively account for the sulfur.

Under typical reducing atmospheres during pyrolysis, most of the sulfur comes off in the form of hydrogen sulfide ($H_2S$). In the presence of oxygen, hydrogen sulfide reacts to form sulfur dioxide ($SO_2$). Since oxygen is a by-product of coal decomposition and is present in the evolved gas, it is likely that some of the $H_2S$ will actually evolve as $SO_2$. Therefore, the amount of $SO_2$ as well as the amount of $H_2S$ in the evolved gas was measured. Sulfur dioxide was absorbed in a one percent solution of hydrogen peroxide. The sulfur dioxide was oxidized in the solution and converted to sulfuric acid. The solution was then titrated with sodium hydroxide and methyl red indicator.

Hydrogen sulfide was absorbed in a zinc acetate solution. The hydrogen sulfide reacts with the absorbent to form a zinc sulfide precipitate. Then a measured quantity of potassium iodide/iodate solution is added to the absorbent solution and precipitate. Next the mixture is acidified with concentrated hydrochloric acid and stirred rigorously with a magnetic stirrer. The presence of acid causes the potassium iodide (KI) and potassium iodate ($KIO_3$) to react and form iodine ($I_2$). The iodine quickly reacts with the zinc sulfide to form sulfur and zinc iodide. The excess iodine is back-titrated with sodium thiosulphate and starch indicator.

Procedure

A coal sample of approximately 45 grams is dried in air at 110° C. for 24 hours, weighed and then loaded into the bomb. Hydrogen peroxide solution (150 ml) is poured into the last two absorbers, and zinc acetate solution (140 ml) is poured into the other two absorbers. The oven and recorder are turned on, and the nitrogen flow is set at approximately 40 ml/min. The oven is allowed to heat up overnight to the first temperature step. The absorbing solutions are then replaced and analyzed. The oven temperature, coal temperature, wet test meter reading and time are recorded, and the oven is turned up (approximately 40° C.) to the next temperature step. Then the coal is held at the new temperature for a defined period of time, the absorbing solutions are again replaced and analyzed, and the necessary data recorded. This cycle is continued until the coal temperature exceeds 800° C.

RESULTS

Representative results are summarized below.

| | Run No. 8-21 | | | |
|---|---|---|---|---|
| Temp (°C.) | Sulfur Evolved (g) | Sulfur Evolved During 25° C. Interval (g) | Gas Evolved (ml @ STP) × $10^{-2}$ | Gas Evolved During 25° C. Interval (ml @ STP) × $10^{-2}$ |
| 200 | 0.00 | | 0 | |
| 225 | 0.00 | 0.00 | 0 | 0 |
| 250 | 0.00 | 0.00 | 1 | 1 |
| 275 | 0.00 | 0.00 | 2 | 1 |
| 300 | 0.01 | 0.01 | 3 | 1 |
| 325 | 0.02 | 0.01 | 4 | 1 |
| 350 | 0.04 | 0.02 | 5 | 1 |
| 375 | 0.13 | 0.09 | 10 | 5 |
| 400 | 0.30 | 0.17 | 14 | 4 |
| 425 | 0.53 | 0.23 | 19 | 5 |
| 450 | 0.83 | 0.30 | 26 | 7 |
| 475 | 1.50 | 0.67 | 33 | 7 |
| 500 | 2.64 | 1.14 | 56 | 23 |
| 525 | 3.20 | 0.56 | 81 | 25 |
| 550 | 3.48 | 0.28 | 103 | 22 |
| 575 | 3.60 | 0.12 | 125 | 22 |
| 600 | 3.62 | 0.02 | 141 | 16 |
| 625 | 3.64 | 0.02 | 156 | 15 |
| 650 | 3.65 | 0.01 | 170 | 14 |
| 675 | 3.65 | 0.00 | 181 | 11 |
| 700 | 3.66 | 0.01 | 192 | 11 |
| 725 | 3.66 | 0.00 | 203 | 11 |
| 750 | 3.67 | 0.01 | 213 | 10 |
| 775 | 3.67 | 0.00 | 224 | 11 |
| 800 | 3.67 | 0.00 | 230 | 6 |

When the evolved sulfur and the evolved gas are plotted separately against coal temperature, it is not readily apparent that a gas fraction can readily be selected to maximize the content of sulfur and minimize the gas volume. However, by preparing a plot showing rate of sulfur evolution at 25° C. heating interval and superimposing a plot of the rate of gas evolution, the basis for the method of the present invention can be observed. FIG. 1 of the accompanying drawing illustrates such a combined plot for Run No. 8–21, which corresponds with the data reported in Table B. This plot demonstrates that the rate of sulfur evolution is substantially higher at temperatures in the range from 375° to 550° C., particularly from 400° to 525° C., especially in the range from 450 to 525° C., than the rate of gas evolution. Gas evolution rates which are low during the part of the cycle when sulfur evolution rates are high rise as sulfur content decreases. Thus, the sulfur can be concentrated in smaller amounts of gas by this technique.

We claim:

1. The method of removing sulfur from coal, comprising:

(a) subjecting subdivided pyritic sulfur-containing coal to heat decomposition with evolution of gas containing sulfur compounds;

(b) progressively increasing the temperature of said decomposition from a temperature range below 375° C. to a temperature range above 550° C.;

(c) separately collecting gas evolved within the temperature range from 375° to 550° C. which separately collected gas contains at least 60% by weight of the total decomposable pyritic sulfur in not over 40% by volume of the total evovable gas; and (d) continuing said heating at temperatures above 550° C. without combining the thus-evolved gas with said separately collected gas.

2. The method of claim 1 in which said coal contains at least 2% of pyritic sulfur based on the dry weight of the coal.

3. The method of claim 1 in which said gas fraction is collected at a temperature within the range from 450° to 525° C.

4. The method of claim 3 in which said separate gas fraction comprises less than 35% by volume of the total evolvable gas.

5. The method of claim 3 in which said separate gas fraction contains mroe than 70% by weight of the total evolvable pyritic sulfur.

6. A method of removing sulfur from coal containing inexcess of 1% pyritic sulfur based on the dry weight of the coal, comprising:

(a) subjecting the coal in subdivided condition to heat decomposition with evolution of gas containing sulfur compounds;

(b) progressively increasing the temperature of said decomposition from a temperature range below 400° C. to a temperature range above 525° C.;

(c) separately collecting a evolved gas within the temperature range from 400° to 525° C. which separately collected gas contains more than 70% by weight of the total decomposable pyritic sulfur in not over 40% by volume of the total evolvable gas; and (d) continuing said heating at temperatures above 550° C. without combining the thus-evolved gas with said separately collected gas.

7. The method of claim 6 in which said coal contains at least 2% of pyritic sulfur based on the dry weight of the coal.

8. The method of claim 6 in which said pyrolytic decomposition is carried out by progressively heating said coal from at least 200° up to at least 800° C., and in which additional gas fractions are separately collected within the temperature ranges respectively from 200° to 400° and 525° to 800° C.

9. The method of claim 8 in which said additional gas fractions are combined to obtain a product gas which does not require desulfurization.

* * * * *